US005503069A

United States Patent [19]

Blim

[11] Patent Number: 5,503,069

[45] Date of Patent: Apr. 2, 1996

[54] INKING AND PRINTING SYSTEM

[75] Inventor: Werner Blim, Frankenthal, Germany

[73] Assignee: Albert-Frankenthal Aktiengesellschaft, Frankenthal, Germany

[21] Appl. No.: 354,097

[22] Filed: Dec. 6, 1994

[30] Foreign Application Priority Data

Dec. 6, 1993 [DE] Germany ..... 43 41 534.2

[51] Int. Cl.[6] ..... B41F 5/18; B41F 31/06

[52] U.S. Cl. ..... 101/216; 101/363

[58] Field of Search ..... 101/157, 169, 101/153, 363, 148, 366, 425, 207, 208, 209, 210, 350, 216, 219, 178

[56] References Cited

U.S. PATENT DOCUMENTS

| | | | |
|---|---|---|---|
| 1,837,702 | 12/1931 | Canfield . | |
| 2,377,089 | 5/1945 | Lundbye . | |
| 3,022,907 | 2/1962 | Palasciano . | |
| 3,090,092 | 5/1963 | Szemplak . | |
| 3,090,302 | 5/1963 | Johnson . | |
| 3,545,381 | 12/1970 | Jorgensen . | |
| 3,896,730 | 7/1975 | Garrett et al. | 101/425 |
| 4,426,412 | 1/1984 | Gebert | 427/356 |
| 4,480,548 | 11/1984 | Rebel et al. | 101/425 |
| 4,532,863 | 8/1985 | Bavoux et al. | 101/153 |
| 4,729,309 | 3/1988 | Saterini et al. . | |
| 5,012,736 | 5/1991 | Vankanegan et al. | 101/210 X |

FOREIGN PATENT DOCUMENTS

| | | |
|---|---|---|
| 0234456 | 9/1987 | European Pat. Off. . |
| 3313219 | 10/1984 | Germany . |
| 3151005 | 3/1986 | Germany . |

OTHER PUBLICATIONS

Patent Abstracts of Japan; Pub. No. JP63116851; App. No. JP-860263424 Dated Nov. 5, 1986; vol. 12, No. 360.

*Primary Examiner*—J. Reed Fisher
*Attorney, Agent, or Firm*—Jones, Tullar & Cooper

[57] ABSTRACT

An inking and printing system which is usable with fast drying inks uses a housing and a plurality of spray nozzles to apply an ink solvent to the surfaces of printing cylinders after a printing line or contact line. The application of the solvent prevents ink remaining on the printing cylinder, after contact with a paper web being printed, from drying.

10 Claims, 1 Drawing Sheet

FIG.1
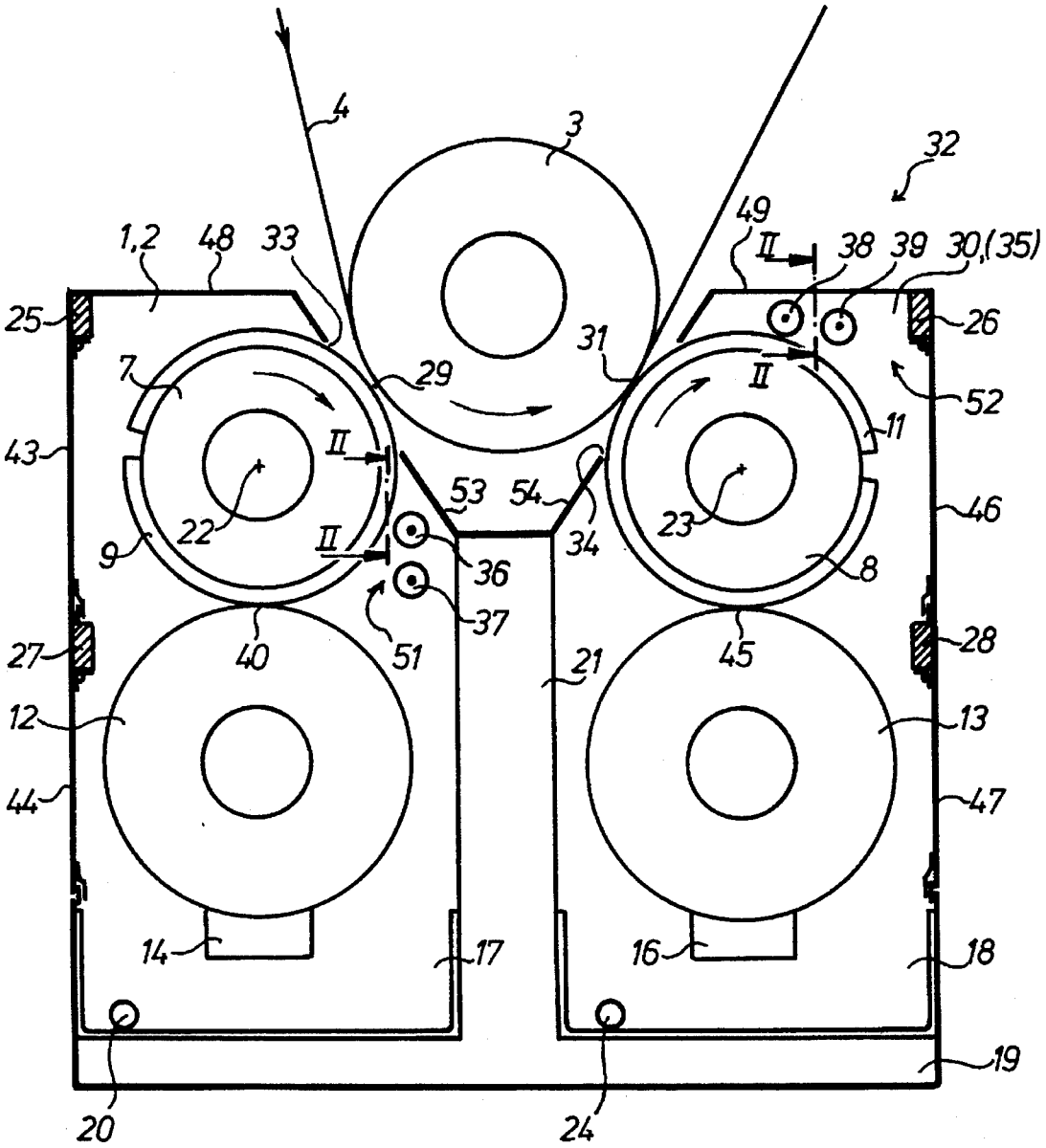
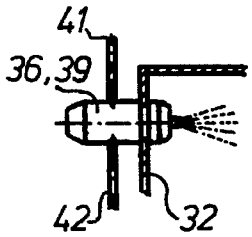
FIG.2

INKING AND PRINTING SYSTEM

FIELD OF THE INVENTION

The present invention is directed generally to an inking and printing system. More particularly, the present invention is directed to an inking and printing system which uses quick drying ink. Most specifically, the present invention is directed to an inking and printing system contained in a closed housing and having ink solvent spray nozzles. The inking and printing system utilizes one counter pressure cylinder and two separate plate cylinders, each with a separate ink applicator roller. The ink applied to the plate cylinder may be a quick drying ink. Downstream from a contact line between the plate cylinder and the counter pressure cylinder, and within the housing, there are located a plurality of ink solvent spray nozzles. These nozzles are used to spray an ink solvent onto the plate cylinders and to thereby prevent ink remaining on the plate cylinder after printing from drying.

DESCRIPTION OF THE PRIOR ART

Printing units which are structured to allow a flying change in the text or image being printed are called imprinters. These imprinters are known generally in the art. One such imprinter is shown in German Patent Publication DE 33 13 219 A1. In this prior art device, two printing cylinders are provided and can selectively be applied against a counter-pressure cylinder which guides a paper web. The paper web will be printed by the one of the two printing cylinders that is in contact with the counter-pressure cylinder. An ink supply roller, which provides the printing plates on the printing cylinder with ink can be placed against the printing cylinder which is being used. A hard screen roller is employed as the ink supply roller and cooperates with the soft printing plates that are located on the printing cylinder.

In this prior art imprinter unit a problem arises when a quick drying ink is being used. The ink that remains on the printing plates, after the plates have been in contact with the paper web, quickly dries. This results in the build-up of a layer of dried ink and this dried ink is apt to take up the freshly applied ink. The result is a noticeable loss of quality in the printing process.

It will be seen that a need exists for a quick change or imprinter type of printing unit that avoids the limitations of the prior art devices. The inking and printing system in accordance with the present invention provides such a device and is a significant improvement over the prior art devices.

SUMMARY OF THE INVENTION

It is an object of the present invention to provide an inking and printing system.

Another object of the present invention is to provide an inking and printing system which may use quick drying ink.

A further object of the present invention is to provide an inking and printing system that is situated in a housing.

Yet another object of the present invention is to provide an inking and printing system using quick drying inks which prevents premature drying of the ink remaining on the printing plates of the printing cylinder immediately following a printing process.

Still a further object of the present invention is to provide an inking and printing system having ink solvent spray nozzles located within a housing containing the printing and inking cylinders.

As will be discussed in greater detail in the description of the preferred embodiment which is set forth subsequently, the inking and printing system in accordance with the present invention utilizes a counter pressure cylinder that is engageable with one of two printing cylinders. Each printing cylinder carries one or more soft printing plates. A quick drying ink can be applied to the printing plates on each one of the two printing cylinders by one of two hard surfaced ink applicator rollers. The ink applicator rollers and their associated printing cylinders are enclosed within a housing that allows the printing cylinders to project beyond the housing only along a contact line with the counter pressure cylinder. A plurality of ink solvent spray nozzles are positioned within the housing. These spray nozzles direct a spray of an ink solvent onto the surfaces of the printing plates on the operating printing cylinder after the contact line.

The application of the ink solvent to the printing plates on the printing cylinder and the enclosure of the printing cylinders and the ink applicator rollers in the housing is effective in preventing the accumulation of dried ink on the printing plates. The quick drying ink that remains on the printing plates downstream of the contact line with the paper web supported by the counter-pressure cylinder does not dry because of the application of the ink solvent through the spray nozzles. Thus the degradation of print quality, which has been a problem in the prior art devices, is taken care of by the printing and inking system of the present invention.

The inking and printing system in accordance with the present invention overcomes the problems present with the prior art devices. It is a substantial advance in the art.

BRIEF DESCRIPTION OF THE DRAWINGS

While the novel features of the inking and printing system in accordance with the present invention are set forth with specificity in the appended claims, a full and complete understanding of the invention may be had by referring to the detailed description of the preferred embodiment which is set forth subsequently, and as illustrated in the accompanying drawings, in which:

FIG. 1 is a schematic side elevation view of an imprinter having the inking and printing system of the present invention; and FIG. 2 is a cross-sectional view taken along line II—II of FIG. 1.

DETAILED DESCRIPTION OF THE PREFERRED EMBODIMENT

Referring initially primarily to FIG. 1, there may be seen an imprinter printing unit, which is capable of making on the fly changes of the text or image being printed, and which uses an inking and printing system in accordance with the present invention. A counter-pressure cylinder 3 is supported for rotation and rotates in a counter-clockwise manner, as depicted by the arrow on the cylinder. A paper web 4, which is received from another portion of the printing unit, not specifically shown, passes around the counter-pressure cylinder 3, which is supported between spaced side frames 1 and 2 of the printing unit. The counter-pressure cylinder cooperates selectively with one of two printing cylinders 7 and 8 which are each supported for rotation between the side frames 1 and 2. Each of these two printing cylinders 7 and 8 can be supported with eccentric bushings (not shown) so that each can be selectively brought into contact with the counter-pressure cylinder 3. Alternatively, the counter-pressure cylinder 3 can be supported by rockers (not shown) and can be brought into selective engagement with either one of the printing cylinders 7 and 8 which would then be rotatably supported in a non-shiftable manner between the side frames 1 and 2.

Each of the printing cylinders 7 and 8 is provided with at least one printing plate 9 and 11. In the present invention, these printing plates 9 and 11 are made using a flexible, resilient material such as is known as being usable in a flexographic printing process. A hard, screened surface ink application roller 12 or 13, such as an anilox roller, is supported between the side frames 1 and 2 in cooperation with a respective one of the printing cylinders 7 and 8. Each of the screened ink application rollers 12 and 13 can be moved into and out of contact with its respective printing cylinders 7 or 8 by use of generally well known eccentric bushings which are not specifically shown. Each of the ink applicator rollers 12 and 13 is provided with ink on its hard, screened surface by being in contact with an ink supply device, such as a chambered doctor blade 14 and 16. These chambered doctor blades 14 and 16 are disposed beneath their respective ink application rollers 12 and 13, as may be seen in FIG. 1. Any excess ink, which may be doctored off the ink application rollers 12 and 13, is collected in an ink collection trough 17 or 18 which underlies its respective ink application roller 12 or 13 and doctor blade 14 or 16. This excess ink is removed from the collection trough 17 or 18 through a return line 20 or 24 to a supply reservoir (not shown) from whence it is again supplied to the chambered doctor blades 14 and 16. The ink from the hard ink application rollers 12 and 14 is supplied to the resilient printing plates 9 and 11 of the printing cylinders 7 and 8 and is then applied to the paper web 4. Which one of the printing cylinders 7 or 8 which is in contact with the counter-pressure cylinder 3 will determine which printing plate or plates 9 or 11 is printing on the paper web 4.

The excess ink collection troughs 17 and 18 are supported by a base frame 19 so that they underlie and extend along axes of rotation of their associated ink application rollers 12 and 14. A central, generally vertically extending support partition 21 separates the two troughs 17 and 18. This support partition 21 extends along beneath the counter-pressure cylinder 3. The top of the support partition 21 is disposed beneath the level of the rotating shafts 22 and 23 of the printing cylinders 7 and 8 and above the upper peripheries of the ink application rollers 12 and 13. The two spaced side frames 1 and 2 of the printing press assembly are connected to each other by a plurality of spaced, transverse reinforcement bars 25, 26, 27 and 28, each of which extends generally parallel to the axes of rotation of the various rollers and cylinders discussed above. These reinforcement bars 25–28 can also be interconnected by additional vertically extending reinforcement struts that are not specifically shown in FIG. 1.

The side frames and the reinforcement bars 25–28, together with the base frame 18 create a frame that surrounds the printing cylinders 7 and 8 as well as the ink application rollers 12 and 13. This frame has an external casing of sheet metal panels which may, for example, be a rustproof steel. These panels form a housing, generally at 32, around the cylinders and plates. As may be seen in FIG. 1, a pair of slots 33 and 34 are provided in the housing 32 to allow the two printing cylinders 7 and 8 to selectively engage the counter-pressure cylinder 3 along respective contact or printing lines 29 and 31 between the printing cylinder 7 and the counter-pressure cylinder 3 or between the printing cylinder 8 and the counter-pressure cylinder 3. This will allow the paper web 4 to be printed by either the printing cylinder 7 or 8 depending on which of these two printing cylinders 7 or 8 is in contact with the counter-pressure cylinder 3 along its respective contact or print line 29 or 31.

The support partition 21, as discussed previously, extends across between the two press side frames 1 and 2 generally in the axial direction of the various cylinders and rollers. At its upper end, away from the base frame 19, the support partition 21 is provided with a pair of stub walls 53 and 54 which are angled outwardly and which have free upper ends which define the lower edges of the slots or slits 33 and 34. The housing 32 and the stub walls 53 and 54 thus effectively enclose the printing cylinders 7 and 8, the ink application rollers 12 and 13 and the chamber doctor blades 14 and 16. The only exposure of these components to the surrounding environment is through the slits 33 and 34.

Referring again primarily to FIG. 1 of the drawings, a plurality of spray nozzles are disposed in pairs 36 and 37 or 38 and 39. These nozzles are secured to end faces 30 and 35 of the housing 32 with each nozzle pair being located after, in the direction of rotation of its respective associated printing cylinder 7 or 8, the respective contact line or print line 29 or 31. Thus the nozzle pair 36 and 37 are located after, in the direction of rotation of printing cylinder 7, the contact or print line 29 between cylinder 7 and counter-pressure cylinder 3. Similarly, the nozzle pair 38 and 39 is located after, in the direction of rotation of printing cylinder 8, the contact or print line 31 between cylinder 8 and counter-pressure cylinder 3. The first end face 30 of the housing 32 is visible in FIG. 1 while the second, similar end face 35 is not visible since FIG. 1 is a cross-sectional view. It will be understood that two of the nozzle pairs 36 and 37 or 38 and 39 are provided for each of the printing cylinders 7 and 8. It will also be understood that two of these nozzle pairs are not shown in FIG. 1 since they are secured to the end face 35 of the housing 32 and this end face 32 is not shown in the drawings.

Each of the nozzles 36–39 is, as may be seen most clearly in FIG. 2, is connected to a compressed air supply line 41 and to an ink solvent supply line 42. The sources of the compressed air and of the ink solvent are not specifically shown in the drawings. The solvent may be toluene, alcohol, water or any other generally known ink solvent in accordance with the type of ink that is being used.

Each of the depicted pairs of spray nozzles 36 and 37, and 38 and 39, secured in end face 30 of the housing 32, as well as the similar nozzle pairs positioned in the not shown end face 35 of the housing 32, are pointed to spray generally in a direction parallel to the axes of rotation of their respective printing cylinders 7 and 8. In each nozzle pair, such as in pair 36 and 37, each of the spray nozzles has a different stream width and length. Thus spray nozzle 36 can cover an area of the surface of printing cylinder 7 which accounts for the first one fourth of the axial length of the cylinder 7. Spray nozzle 37 will cover the second one fourth of the axial length of the cylinder 7. The other pair of spray nozzles 36 and 37, which are not shown in the drawings, will cover the third and fourth quarters of the length of the printing cylinder 7. This will insure that the entire surface of the printing cylinder 7, after the contact or printing line 29, is sprayed with the air and solvent mixtures from the nozzles pairs 36 and 37. This same location, spray pattern, and spray pressure also holds for the visible spray nozzle pair 38 and 39 on the housing end face 30 as well as the similar nozzle pair that are located on the not shown housing end face 35. These second nozzle pairs 38 and 39 provide a coating of ink solvent to the entire surface of the printing cylinder 8 after its contact or printing line 31 with the counter-pressure cylinder 3.

Printing ink is transferred to the printing cylinders 7 and 8, and specifically to the printing plates 9 and 11 secured to the printing cylinders 7 and 8, from the ink application rollers 12 and 13. The ink application rollers 12 and 13 receive their ink from the chambered doctor blades 14 and 16. The ink transfer to the printing cylinders 7 and 8 takes place in ink transfer zones 40 and 45, respectively. These ink transfer zones 40 and 45 are after, in the direction of rotation of the printing cylinders 7 and 8, the nozzle pairs 36, 37 and 38, 39 but before the contact or print lines 29 or 31, respectively. These ink transfer zones 40 and 45 are axially extending lines or strips. In the preferred embodiment, the chamber doctor blades 14 and 16 are disposed beneath the ink application rollers 12 and 13. It would also be possible to provide ink transfer devices in the form of inking rollers which dip into ink troughs and which then transfer the ink to the printing cylinder 7 or 8. Alternatively, rotogravure ink could be distributed on a rotogravure printing cylinder which dips into an ink trough. In this instance, it will be necessary to supply a separate, generally well known doctor blade assembly.

The operation of the inking and printing system in accordance with the present invention is as follows. The paper web 4 to be printed at either of the contact or print lines 29 or 31 with a quick drying ink is guided around the counterclockwise rotating counter-pressure cylinder 3. As depicted in FIG. 1, the paper web 4 is in contact with one of the printing plates 11 on the surface of the printing cylinder 8 in the area of the printing or contact line 31. After the printing plate 11 has transferred ink to the paper web 4, the clockwise rotation of the printing cylinder 8 will cause the printing plate 11 to pass by the nozzle pairs 38 and 39. These nozzle pairs 38 and 39, which are located in the end faces 30 and 35 of the housing 32, as has been discussed previously, will deposit a coating or spray of an ink solvent and air mixture on the surface of the printing plate 11. This solvent and air mixture, which may be a toluene and air mixture, will prevent a rapid drying of the residual ink remaining on the printing plate 11 and not removed by contact of the plate 11 with the web 4. It will be understood that the two sets of nozzle pairs 38 and 39 will be in operation with printing cylinder 8 and that the two sets of nozzle pairs 36 and 37 will be in operation with the printing cylinder 7.

The ink solvent-air mixture from the nozzle pairs 38 and 39 is sprayed into a spray chamber 52 which starts after, in the direction of rotation of the printing cylinder 8, the print line 31 and which is defined by the housing 32 and the jacket surface of the printing cylinder 8, and which terminates at the ink transfer line or zone 45. In a similar manner, the nozzle pairs 36 and 37 spray into a spray chamber 51 which is after the contact or print line 29, before the ink transfer zone or line 40 and defined by the housing 32 and the surface of the printing cylinder 7. In both instances, the application of the ink solvent and compressed air mixture prevents drying of the ink residue on the printing plates 9 or 11 before these plates come back into contact with the ink application rollers 12 or 13.

It is also possible, in accordance with the present invention, to provide several spray nozzles after the printing lines 29 or 31 with these spray nozzles being situated next to each other axially along the housing 32 and directed in a radial direction toward the surfaces of the printing cylinders. These nozzles could be provided as so-called fan-jet nozzles which spray in a strip-shaped or fan-shaped pattern.

The type of ink solvent supplied to the spray nozzle pairs 36, 37 and 38, 39 will be dependent on the type of ink being applied by the ink application rollers 12 and 13. If the printing ink is a quick-drying ink then a suitable solvent, such as toluene will be used. If the ink being used is a water based ink; i.e. a so-called flexographic ink, then the solvent used may be water. Preferably this water used as the solvent is a so-called "low-surface-tension" water which is water that has been constituted to have as low a surface tension as possible. This low surface tension water is sprayed onto the surfaces of the printing cylinders in the spray chambers 51 and 52 to prevent rapid drying of the water-based, flexographic ink.

Since it may be necessary to access the printing cylinders and the ink application rollers within the housing 32, a plurality of removable covers may be provided as part of the housing. As may be seen in FIG. 1, removable side covers 43 and 44 are provided adjacent printing cylinder 8 and ink application roller 12, respectively. In a similar manner, removable side covers 46 and 47 are provided in housing 32 adjacent printing cylinder 9 and ink application roller 13. If desired, these side covers 43, 44, 46 and 47 can be locked in their closed positions. Upper covers 48 and 49 which overlie the printing cylinders 7 and 8, respectively, are also provided as a part of the overall housing 32. It will be understood that the side frames 1 and 2 also constitute a portion of the housing 32 which effectively encloses the printing cylinders and ink application rollers and confines the ink solvent and compressed air spray to the spray zones.

While a preferred embodiment of an inking and printing system in accordance with the present invention has been set forth fully and completely hereinabove, it will be apparent to one of skill in the art that a number of changes in, for example the overall size of the cylinders, the drive means for the cylinders, the compressed air supply source and the like could be made without departing from the true spirit and scope of the present invention which is accordingly to be limited only by the following claims.

What is claimed is:

1. An inking and printing system usable to apply a printing ink to a paper web being printed, said system comprising:

a counter-pressure cylinder supported for rotation about an axis of rotation between spaced side frames of a printing press;

at least a first printing cylinder provided with at least a first printing plate and supported for rotation between said side frames, said printing cylinder being engageable with said counter-pressure pressure cylinder along a printing line;

at least a first ink application roller supported for rotation between said side frames and engageable with said printing cylinder along an ink transfer line to supply ink to said printing plate;

means to supply ink to said ink application roller;

a housing surrounding said printing cylinder, said ink application roller and said ink supply means said housing having a slot extending parallel to said axis of rotation of said counter-pressure cylinder, said counter pressure cylinder being located outside of said housing and contacting said printing plate on said printing cylinder at said slot; and a plurality of ink solvent spray nozzles located within said housing after, in a direction of rotation of said printing cylinder, said printing line and before said ink transfer line, said spray nozzles being usable to spray an ink solvent on said printing plate after said printing plate has contacted said counter-pressure cylinder and before said printing plate contacts said ink application roller, said ink solvent applied by said spray nozzles preventing drying of said ink supplied to said printing plate and remaining on said printing plate after said printing plate contacts said counter-pressure cylinder and before said printing plate contacts said ink application roller.

2. The system of claim 1 wherein said housing includes spaced end faces and side faces and further wherein said spray nozzles are disposed on said side faces in an axial direction of said printing cylinder.

3. The system of claim 1 wherein said spray nozzles are jetspray nozzles.

4. The system of claim 1 wherein said means to supply ink to said ink application roller is an inking roller dipping into an ink trough.

5. The system of claim 1 wherein said means to supply ink to said ink application roller is a chamber doctor blade.

6. The system of claim 1 wherein said ink application roller is a hard screened anilox roller.

7. The printing system of claim 1 wherein said printing plate is a flexographic printing plate.

8. The system of claim 1 wherein said ink solvent is toluene.

9. The system of claim 1 wherein said ink solvent is alcohol.

10. The system of claim 1 wherein said ink solvent is water.

* * * * *